US008740587B2

(12) United States Patent
McCauley

(10) Patent No.: US 8,740,587 B2
(45) Date of Patent: Jun. 3, 2014

(54) APPARATUS AND METHOD FOR PUMPING IN AN ION OPTICAL DEVICE

(75) Inventor: Edward B. McCauley, Cedar Park, TX (US)

(73) Assignee: Thermo Finnigan LLC, San Jose, CA (US)

( * ) Notice: Subject to any disclaimer, the term of this patent is extended or adjusted under 35 U.S.C. 154(b) by 1091 days.

(21) Appl. No.: 11/636,298

(22) Filed: Dec. 6, 2006

(65) Prior Publication Data

US 2007/0148020 A1 Jun. 28, 2007

Related U.S. Application Data

(60) Provisional application No. 60/753,457, filed on Dec. 22, 2005.

(51) Int. Cl.
*F04D 19/02* (2006.01)

(52) U.S. Cl.
USPC ..... 417/423.4; 137/565.23

(58) Field of Classification Search
USPC ..... 417/423.4; 118/719, 50; 137/565.23
See application file for complete search history.

(56) References Cited

U.S. PATENT DOCUMENTS

| | | | | |
|---|---|---|---|---|
| 5,083,450 | A | 1/1992 | Grindstaff | |
| 5,118,251 | A | 6/1992 | Saulgeot | |
| 5,672,868 | A * | 9/1997 | Mordehai et al. | 250/281 |
| 5,733,104 | A * | 3/1998 | Conrad et al. | 417/44.1 |
| 6,087,657 | A | 7/2000 | Kato | |
| 6,093,005 | A | 7/2000 | Nakamura | |
| 6,339,218 | B1 * | 1/2002 | Kato et al. | 250/288 |
| 6,358,377 | B1 * | 3/2002 | Schloremberg et al. | 204/192.12 |
| 6,566,652 | B1 * | 5/2003 | Kato | 250/288 |
| 6,646,254 | B2 * | 11/2003 | Tanaka | 250/288 |
| 7,001,491 | B2 | 2/2006 | Lombardi et al. | |
| 7,230,232 | B2 * | 6/2007 | Marriott | 250/281 |
| RE40,632 | E * | 2/2009 | Tang et al. | 250/282 |
| 2004/0262155 | A1 | 12/2004 | Lombardi et al. | |

OTHER PUBLICATIONS

Grimsrud, Eric, "A Vacuum Envelope for High Pressure Mass Spectrometry Applications," Analytical Chemistry, vol. 50 ( No. 2), p. 382-384, (1978).

* cited by examiner

*Primary Examiner* — Christopher Bobish
(74) *Attorney, Agent, or Firm* — Nicholas Cairns; Pamela Lau Kee; Thermo Fisher Scientific IP Dept.

(57) ABSTRACT

An apparatus and method for differential pumping of a mass spectrometer or other ion-optical device provides a transverse pressure drop introduced across a face of a primary rotor of a turbomolecular pump by placement of one or more partitions in close proximity to the face of the primary rotor. Thus, two or more regions of space within the vacuum chamber having respective different pressures is achieved with a single pump.

15 Claims, 5 Drawing Sheets

APPARATUS AND METHOD FOR PUMPING IN AN ION OPTICAL DEVICE

CROSS-REFERENCE TO RELATED APPLICATIONS

This application claims priority to U.S. Provisional Patent Application 60/753,457 filed Dec. 22, 2005.

BACKGROUND OF THE INVENTION

1. Technical Field

This invention relates generally to an ion optical instrument, such as a mass spectrometer, combined GC-MS or LC-MS device, or any portion of such a instrument or device, and more specifically to a method and apparatus for pumping from one or more chambers in such a device or instrument.

2. Background

A typical mass spectrometer utilized for GC/MS requires some means of high vacuum pumping. This is necessary primarily for two reasons. The first reason is to remove permanent gasses such as nitrogen, oxygen and carrier gasses such as hydrogen or helium in order to achieve appropriate mean free path lengths for transmission of ion beams. Removal of such gasses additionally prevents unwanted ion-molecule reactions, oxidation of source components and high voltage breakdown. The second reason in maintaining a high vacuum environment is to remove introduced contaminants which would otherwise result in adverse analytical performance. Such adverse performance may include premature degradation in sensitivity or isobaric interference with signal. The introduced contaminants may include sample or matrix molecules, solvent molecules, buffer gasses, reagent gasses, oils from fingerprints, outgassing of plasticizers from polymeric components and the like.

A general configuration useful for the removal of these contaminants involves a turbomolecular pump backed by a suitable roughing pump. Often, multiply pumped systems using more than one turbomolecular pump, or a split flow arrangement are desired due to higher gas loads or a requirement for various sections of the vacuum manifold to operate at different pressures.

In a 1978 article of Analytical Chemistry, Vol. 50, No. 2 by L. P. Grimsrud shows and describes a diffusion pump in combination with a mass spectrometer vacuum chamber having a curtain that divides the chamber into two sections. The curtain is formed of two or three pieces of stainless steel, a baffle, and a butterfly valve. The curtain provides a modest amount of pressure differential during pumping. However, the Grimsrud's description is directed to a diffusion pump, which does not have rotors. As such, Grimsrud's disclosure is lacking in disclosure regarding positioning any elements in the chamber relative to a rotor.

U.S. Pat. No. 7,001,491 to Lombardi et al. has vacuum processing chambers for vapor deposition processing of silicon wafers. Lombardi teaches shielding of processing chamber surfaces and the maintenance and control of vacuum and gas flow in the vacuum processing chambers, at least in part, by shields. Thus, by use of the shields, separate pumps may not be necessary for one or more of the chambers since the shields create pressure differentials.

SUMMARY OF THE INVENTION

Turbomolecular pumps are typically not as efficient as diffusion pumps in pumping light gasses such as helium or hydrogen. However, the demands for low molecular weight gas pumping in modern instruments used for GC/MS are low due primarily to the advent of direct capillary interfacing. At the same time, dramatic improvements in instrument detection limits and the availability of low bleed capillary columns have set new precedents and have shifted the design demands away from high pumping speed, (requiring lower aggregate pressures), to a need to isolate the higher molecular weight component of gas phase molecules in specific regions of the vacuum chamber.

As will be seen, a superior mechanism for chamber isolation can be constructed by causing a transverse pressure drop to occur across the face of the primary rotor section of a turbomolecular pump in accordance with the present invention.

In view of the foregoing, what is desired is an improved method and apparatus for reducing high molecular weight background contaminants in a mass spectrometer utilizing a turbomolecular pump. A superior apparatus and method is provided, taking advantage of the cleanliness of turbo pumped systems, and the high pumping efficiency of single or plural stage rotor/stator sets. The present invention also includes a simple, low cost configuration, which entails little or no modification to the turbomolecular pump used. As will be seen, this invention provides a mechanism which is particularly suited for pumping/removal of higher molecular weight (e.g. greater than 100 amu) contaminants. In general, advantage is taken of a configuration which allows a single pump to provide differential pumping for two or more regions within a vacuum chamber open to a common pump. This allows for a level of differential pumping on singly pumped systems, or an improved arrangement offering extended differential pumping on multi-pump systems.

In a simple form, a vacuum pump system for a mass spectrometry application includes a vacuum chamber having an interior for surrounding at least one low pressure element of a mass spectrometer. The vacuum chamber has a partition isolating a first region of space from a second region of space within interior of the vacuum chamber. The partition may be supported on an inner wall of the vacuum chamber. A turbomolecular pump is operably connected to the vacuum chamber. The turbomolecular pump has a primary rotor having a rotor face or a primary stator having a stator face. The rotor or stator face defines a boundary of the interior of the vacuum chamber. The partition is supported such that an edge of the partition is adjacent to the rotor face.

In one embodiment of the vacuum pump system, the first partition is a first cylindrical partition and the edge is a first edge that forms a first open end of the first cylindrical partition. The first cylindrical partition may have a first closed end opposite the first open end. This embodiment may have a second partition that is a second cylindrical partition with a second edge that forms a second open end. The second edge is to be supported adjacent to the rotor face. The second cylindrical partition may have a second closed end opposite the second open end. The second cylindrical partition is disposed within the first cylindrical partition.

In another more generally expressed embodiment of the present invention, the vacuum chamber has an interior with an inner wall. The partitions include a three dimensional structure that forms a differentially pumped region that is independent of the inner wall. The partitions keep the differentially pumped region independent from a rest of the interior of the vacuum chamber interior and maintain the rest of the interior at a substantially isobaric pressure. The three dimensional structure may have a substantially closed end and a substantially open end. The open end is maintained in close proximity to the primary rotor or stator of the turbomolecular pump.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate generally to an ion optical instrument, such as a mass spectrometer, combined GC-MS or LC-MS device, or any portion of such an instrument or device, and more specifically to an apparatus and method for pumping from one or more chamber in such an instrument or device.

Turbomolecular pumps may be configured with multiple rotor-stator pairs or sets. In some applications, this is necessary in order to achieve adequate pumping for low molecular weight gasses such as hydrogen and helium, which exhibit poor compression ratios across a single rotor stator pair. The compression in these pumps is accomplished in an axial direction. The inlet to the pump conventionally operates at substantially equivalent pressure across the face of the first rotor stage. By introducing a close proximity partition across a face of the primary rotor, which divides the vacuum chamber into a plurality of volume regions, contaminants such as sample matrix, solvents, oils and the like which are introduced into a first of the volume regions within a chamber can be removed, and thus inhibited from entering a second or third region of the chamber. For the overall system, contaminants which are introduced into or emanate from one of the chambers or regions of space within the chamber can be largely isolated from another of the chambers or regions of space. The degree of isolation can be greater than a factor of fifty for molecular weights above one hundred amu. Improvements in mean free path can also be realized for light gasses such as helium (a factor of approximately two or more) which would potentially allow a single pump to be used on a compact gas chromatograph orthogonal acceleration time-of-flight mass spectrometer (GC oa-TOFz), for example, or on another device where differential pumping requirements are modest.

Figure 1:
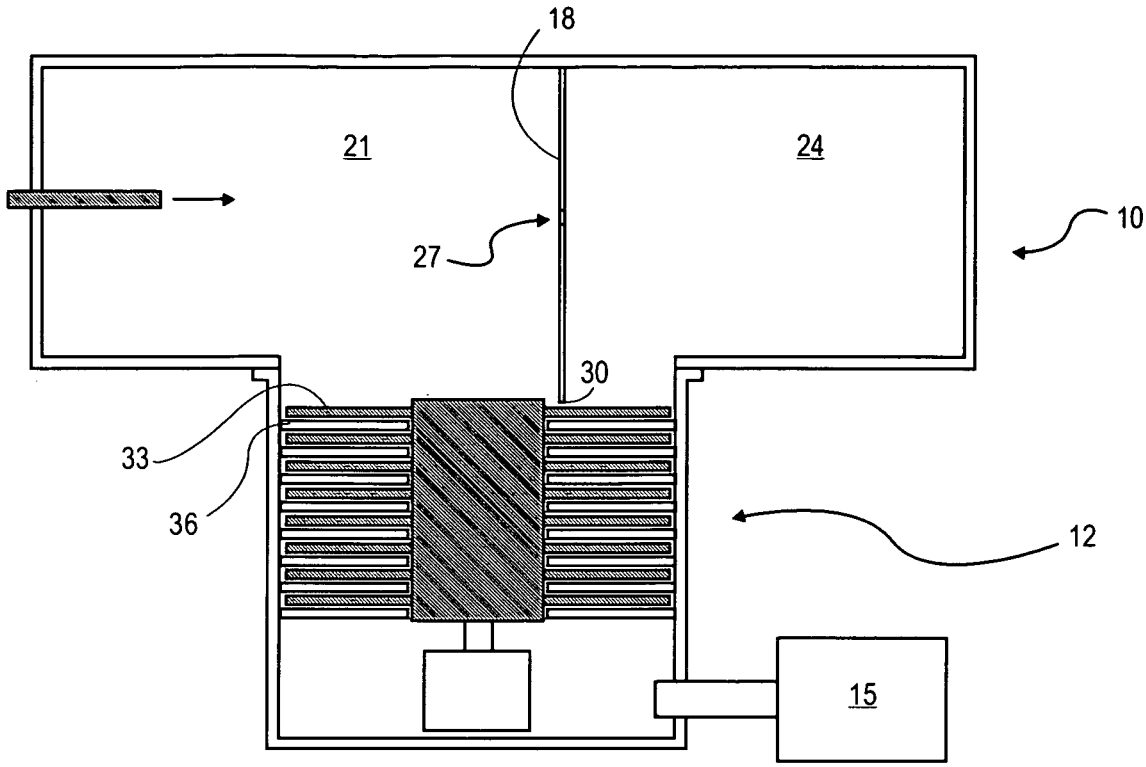
FIG. 1 is a diagrammatic view of a vacuum chamber and pump in accordance with an embodiment of the present invention.

FIG. 1 shows diagrammatic view of a vacuum chamber 10 and turbomolecular pump 12. The vacuum chamber 10 is pumped with a single turbomolecular pump 12 backed by a roughing pump 15. A partition 18 divides the vacuum chamber 10 into two separate regions of space 21 and 24. The partition 18 may maintain substantial contact with surrounding inner walls of an interior of the vacuum chamber 10. The partition 18 may seal the first region of space 21 from a second region of space 24 except for an intermediate orifice 27 or slit and along a lower edge 30, as shown in FIG. 1. A face of a first or primary rotor 33 may provide a boundary between the turbomolecular pump 12 and an interior of the vacuum chamber 10. The lower edge 30 of the partition may reside less than approximately two millimeters away from contact with the first or primary rotor 33 of the turbomolecular pump 12 and the boundary defined by its face. It is to be understood that the spacing between the lower edge 30 and the primary rotor 33 may have a magnitude in a range from approximately one millimeter to approximately ten millimeters. This spacing or separation may be maintained along a bottom edge of the partition between the partition 18 and the rotor 33. The partition may be made to extend entirely across the vacuum chamber. Furthermore, it is to be understood that the relative positions of the rotor 33 and a corresponding stator 36 may be interchanged so that the partition 18 extends to a position spaced in a range from approximately one millimeter to approximately ten millimeters from the stator.

Figure 2A:
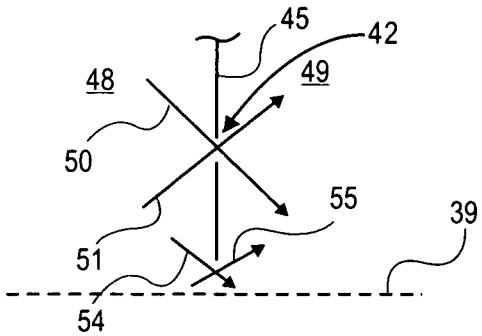
FIG. 2A is a diagram of a conventionally located orifice or slit through an intermediate portion of a wall.
Figure 2B:
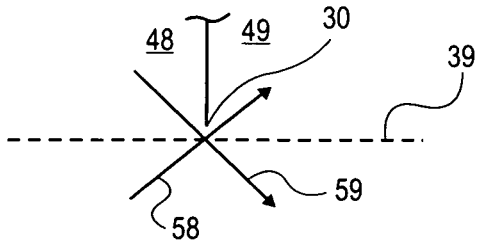
FIG. 2B is a diagram showing an alternative to a conventional slit, and additionally indicating how differential isolation is obtained through the use of a partition maintained in close proximity to the primary rotor of a turbomolecular pump.

FIGS. 2A and 2B show an advantage in the positioning of the partition to extend close to a face 39 of the primary rotor 33. To this end, the spacing between the edge 30 and the face 39 of the primary rotor 33 is depicted in FIG. 2B in comparison to a passageway formed by a conductance orifice 42 or slit in an intermediate portion of a partition 45 as shown in FIG. 2A, for example. In FIG. 2A, the partition 45 defines two vacuum regions 48 and 49. The conductance orifice 42 is located at an intermediate position of the partition. As shown, molecules, (such as unwanted molecules from the sample or contaminants, for example), may be desorbed or deflected from any of the inner surfaces and/or ion optical elements, and pass through the conductance orifice 42 or slit as represented by the arrows 50, 51. Generally, molecules can pass through at more angles, and thus more molecules can be passed because desorbtion and deflection from many locations may be in a line-of-sight of the conductance orifice 42 or slit. The same or even greater effect may exist when the partition 45 is spaced too far from a face 39 of the rotor because the cross sectional area through which the molecules pass as represented by arrows 54, 55 becomes larger and is located at a more intermediate position. Once again, the unwanted molecules may be deflected from inner wall surfaces of the sides, back, top of the vacuum chamber, the blades of the rotor and/or ion optical elements within the vacuum chamber.

On the other hand, FIG. 2B shows a configuration in accordance with the present invention, in which the partition 45 is in close proximity to the inlet represented by a plane or the outermost face 39 of a turbomolecular pump. Once again, the partition 45 defines the regions 48 and 49. A molecule having a flight path into the region 49 of the vacuum chamber would require an original location within the pump (as represented by arrow 58), or would require an initial path traveling toward the pump (as represented by arrow 59). Molecules traveling the path of arrow 59 are likely to be pumped out of the vacuum chamber during operation of the pump. Molecules already in the pump and traveling the path of arrow 58 during operation of the pump are not likely to pass the rotors and return to the vacuum chamber. Alternatively expressed, extending the partition 45 into close proximity relative to the face 39 of the primary rotor in accordance with the embodiments of the present invention transforms the exposed line of sight from a substantially three dimensional volume to an approximately two dimensional plane, thus greatly inhibiting passage of molecules from one region 48 to the other region 49 between the edge 30 and the rotor 33. In a still further alternative expression of the function of the spacing between the edge 30 and the rotor 33, an orifice or "slit" defined between a rotor and a partition that is proximally or adjacently spaced relative to the rotor provides fewer line-of-sight opportunities than does a conventional orifice or "slit" through an intermediate position of the partition or a partition that is significantly spaced from the rotor. As the cross sectional area of the spacing between the partition and the primary rotor decreases the opportunity decreases for contaminants and other unwanted molecules to be deflected from side walls and other elements within the first region 48, around an edge 30 of the partition, and into the second region 49, as shown in FIG. 2B. An example of the difference in magnitude of the differential pressure between regions made possible by an embodiment of the present invention is shown and described with regard to FIG. 9 below.

In a conventional singly pumped system, contaminants are relatively free to migrate throughout the vacuum chamber and deposit on various ion-optical elements or elements of the vacuum chamber. The residence time of these contaminants on surfaces as well as their ability to re-enter the gas phase can vary substantially with molecular weight, chemistry of the contaminant, and the surface chemistry and temperature of the surfaces with which they come in contact. The contamination problem is exacerbated when circuit boards, flex print cables, polymeric components and the like, are introduced into the vacuum chamber. In the case where mean free path requirements have already been satisfied by the pumping system, further improvements in the reduction of background contaminants, in particular, those with molecular weights greater than one hundred amu, for example, can be made in accordance with the present invention. FIG. 1 and several additional embodiments shown in FIGS. 3-7 with a variety of configurations each include a structure or partition that is supported so that an edge of the structure or partition is in close proximity to a face of the primary rotor or stator of a turbomolecular pump. This limits the line-of-sight possibility of unwanted molecules passing from one region to another during operation of the pump, as described above. Additionally, the configurations of these embodiments have the advantage of providing one or more pressure differential between the regions of the vacuum chamber.

Thus, in accordance with a method of the present invention, one or both of steps of reducing a pressure in a second region of space and removing unwanted particles from a first region of space can be effected by the same set of rotors. The method includes providing a second pressure in the second region at a predetermined magnitude relative to a first pressure in the first region of space by positioning the partition in a predetermined orientation and location relative to a face of the set of rotors.

Figure 3:
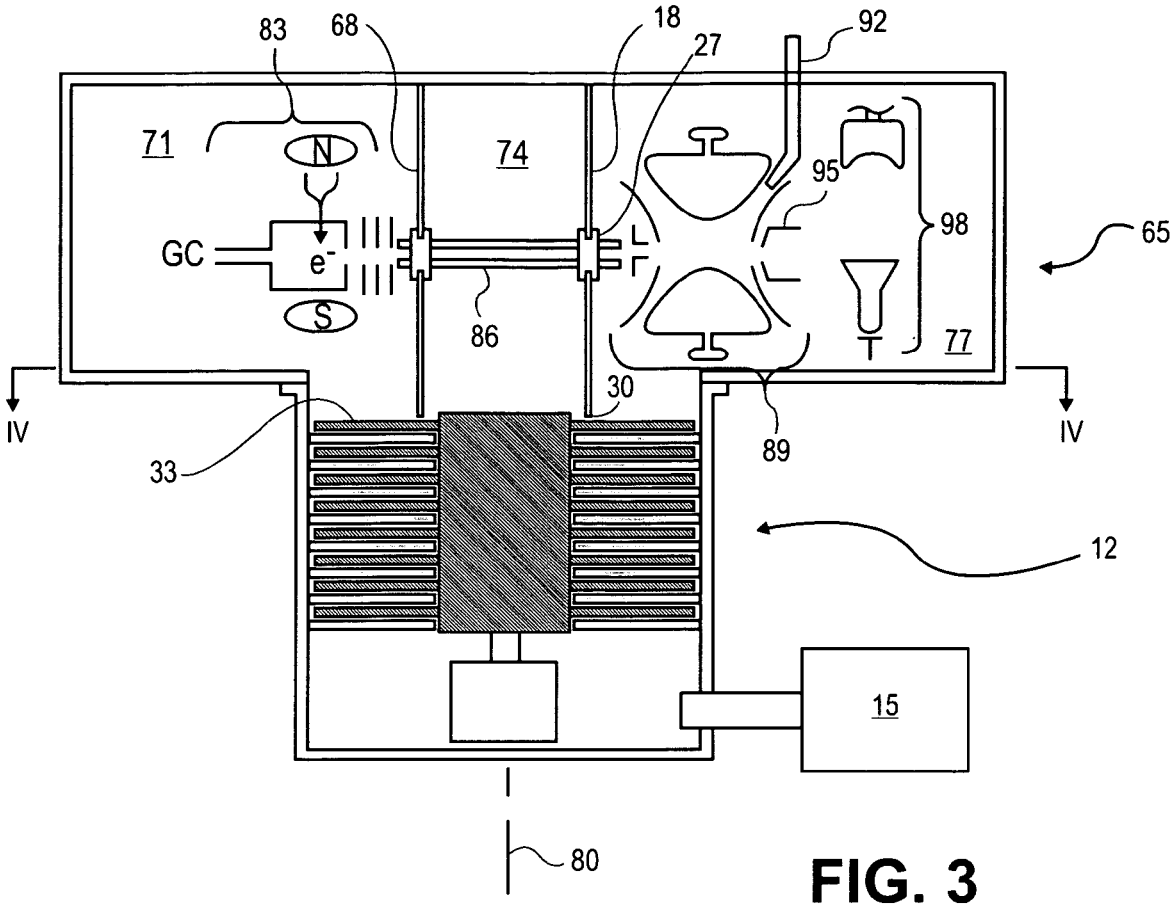
FIG. 3 is diagrammatic view of a vacuum chamber and pump in accordance with another embodiment of the present invention.

FIG. 3 shows a diagrammatic view of a vacuum chamber 65 and turbomolecular pump 12 in accordance with another embodiment of the invention. In addition to a first partition 18, which may be substantially similar to the partition shown and described with regard to FIG. 1, an additional second partition 68 may be placed in the vacuum chamber 65. Instead of having two regions of space, the vacuum chamber in accordance with the embodiment of FIG. 3 is thus divided into three regions of space 71, 74, and 77. A first region 71 and a third region 77 are defined between the partitions 68, 18 and respective portions of an interior of the vacuum chamber. An intermediary region of space 74 is defined between the partitions 18 and 68. The additional or second partition 68 may be formed as a wall that extends to a position in close proximity to a face of the primary rotor 33 similar to the spacing of the first partition 18 from the primary rotor 33. The position of the second partition 68 may or may not be symmetrical with the first partition 18 relative to a rotational axis 80 of the turbomolecular pump 12, as shown in FIG. 3. The intermediary region of space 74 can be used to house a multipole ion guide, a collimating lens, a reaction chamber, a mass analyzer, or other element, for example. This region of space 74 could alternatively be used to house a collision cell, for example, which could potentially operate at a higher pressure than either region of space 71 or 77.

As shown in FIG. 3, the vacuum chamber and pump combination of the present invention may form part of a complete analytical instrument. Although the illustration of FIG. 3 shows the embodiment incorporated into a gas chromatography instrument, it is to be understood that similar embodiments could be implemented with liquid chromatography mass spectrometers. The vacuum chambers of FIGS. 1 and 6-8 can also be applied to both gas chromatography and liquid chromatograph mass spectrometers. As shown in the example of application of FIG. 3, the instrument may have an ion source 83 in the first region of space 71. In the embodiment shown in FIG. 3, the ion source 83 supplies ions to a multipole ion guide 86 in region of space 74. The higher pressure in the region of space 74 corresponding to a central portion of the turbomolecular pump 12 may provide the needed environment for the multipole ion guide 86. An ion trap 89 may be placed in the third region of space 77. Alternatively, one or more of a multipole mass filter or other ion optical element(s) may be substituted for each of the elements shown in the second and third regions 74 and 77 of FIG. 3, and/or additional regions and ion optical elements may be added without limitation. Such additions, substitutions, and/or combinations may also be applied to any of the other embodiments disclosed herein without limitation. Furthermore, additional elements may include a damping gas conduit 92, an ion trap exit lens 95, an ion detector 98, and other element(s).

Figure 4:
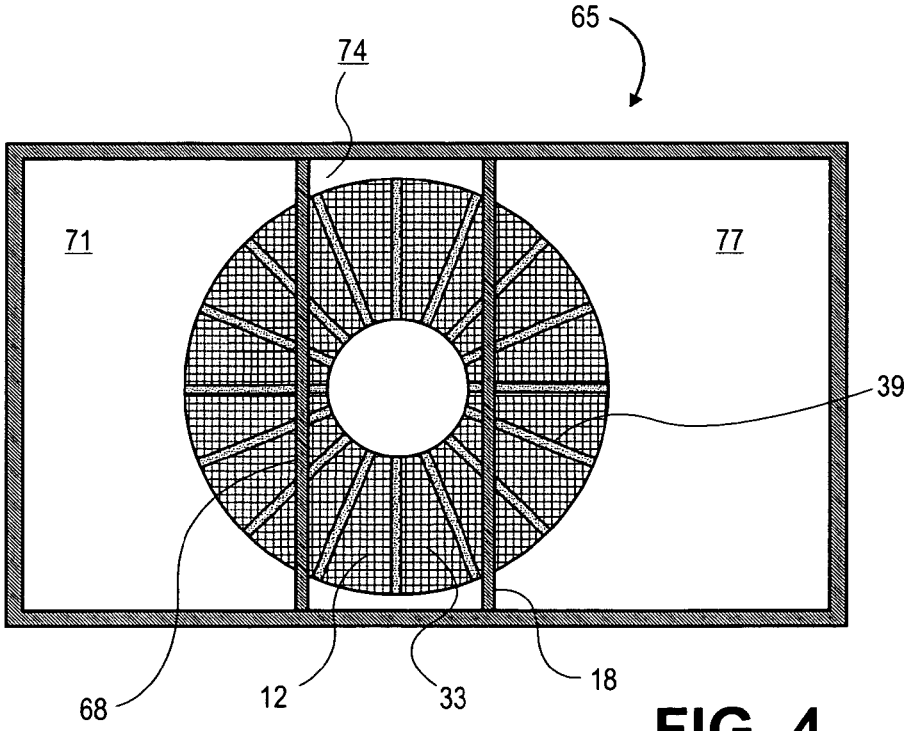
FIG. 4 is a diagrammatic top sectional view taken along line IV-IV of the vacuum chamber of FIG. 3 showing the face of the primary rotor of a turbomolecular pump.

FIG. 4 shows a diagrammatic top sectional view of the vacuum chamber 65 and pump 12 taken along line IV-IV of FIG. 3. Thus, FIG. 4 shows a top view of an inlet of the turbomolecular pump 12. The configuration and positioning of the partitions 18, 68 can be selected to extend completely across the vacuum chamber in a direction transverse to a longitudinal axis of the ion train, as shown in FIG. 4. An entrance to the pump 12 from each of the regions of space 71, 74, and 77 can be divided in such a way so as to expose each region 71, 74, 77 to a predetermined area of a top face 39 of the primary rotor 33. The regions of space 71, 74, and 77 will thus have a corresponding pressure during operation.

Figure 5:
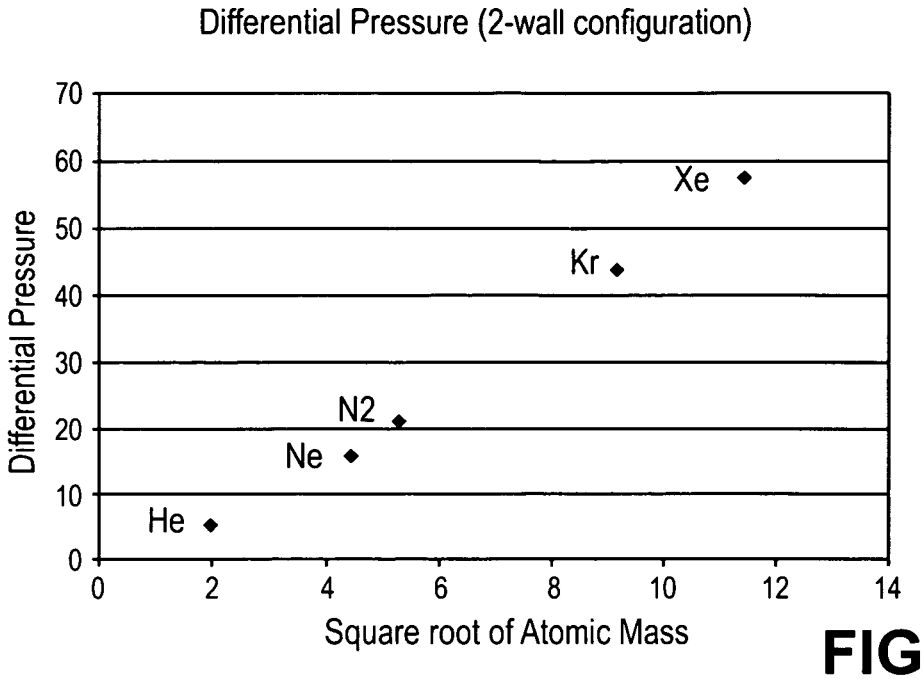
FIG. 5 is an example graph illustrating differential pressure achieved as a function of atomic or molecular mass obtained on a three region vacuum chamber system.

FIG. 5 shows a graph depicting differential pressures based on data gathered using a vacuum pump similar to that depicted in FIGS. 3 and 4. As shown, for efficiently pumped gasses, the degree of isolation increases with the square root of the mass. Furthermore, large differential pressures between the regions of space can be achieved. For example, a high pressure region may have a pressure that is at least approximately fifty times greater than a pressure of a low pressure region for heavy compounds such as those having greater than one hundred amu.

Figure 6:
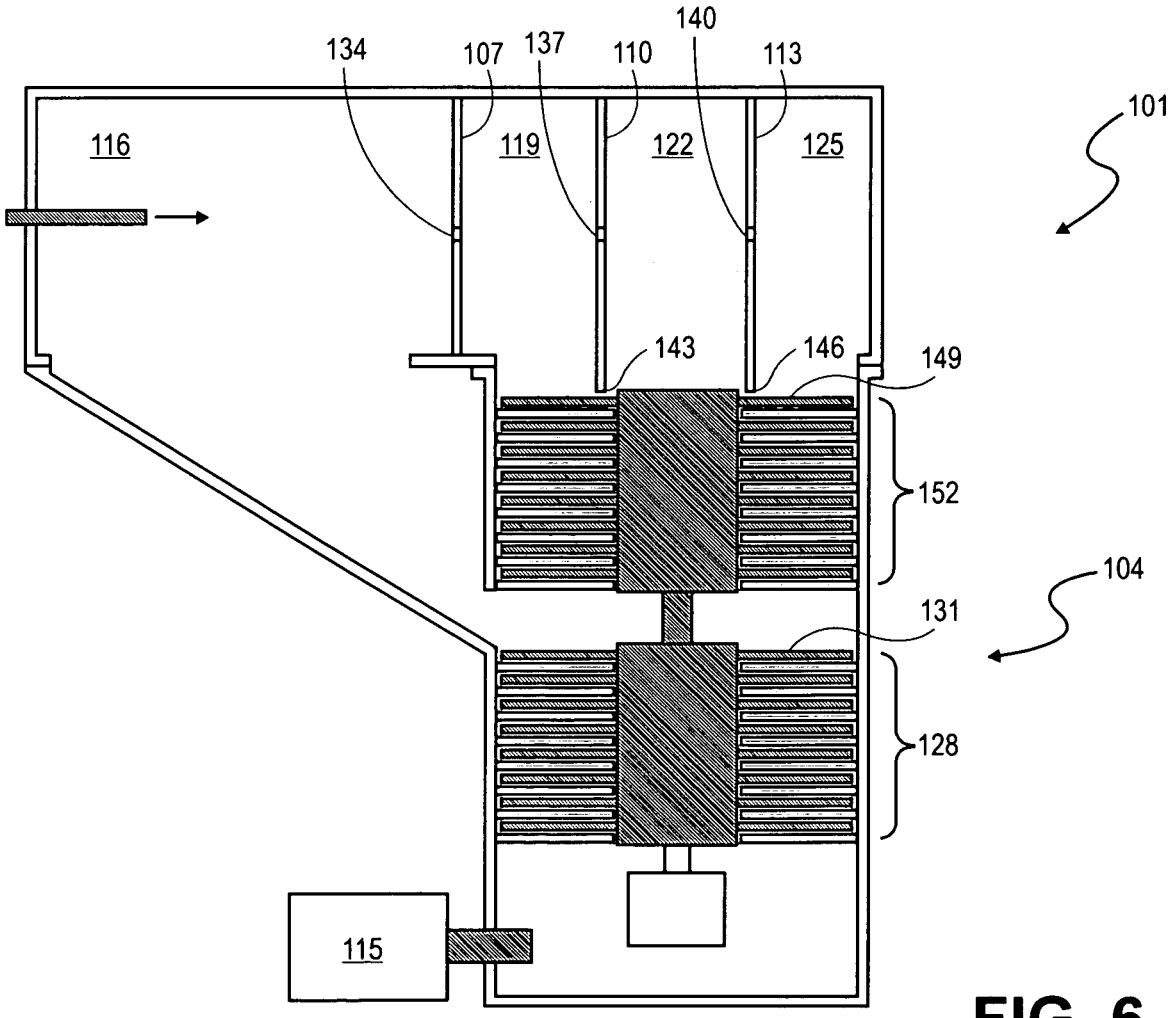
FIG. 6 is a diagrammatic view of a vacuum chamber and split flow pump in accordance with another embodiment of the present invention.

FIG. 6 shows a diagrammatic view of a vacuum chamber 101 and a plural stage split flow pump 104 in accordance with another embodiment of the present invention. FIG. 6 illustrates how combinations of a plurality of discrete pumps or the split flow pump 104 can be used along with close proximity partitions 110 and 113 to enhance isolation of contaminants. In the embodiment of FIG. 6, the partitions 107, 110, and 113 are positioned to form four regions of space 116, 119, 122, and 125. A first region of space 116 is shown in unrestricted fluid communication with a first stage 128 of the turbomolecular pump 104 such that a primary rotor 131, (or alternatively a primary stator of a first set of rotors and stators), forms a face at a boundary corresponding to an inlet of the first stage 128 to the turbomolecular pump 104. Thus, the pressure of the first region of space 116 is generally the same throughout. A first conductance orifice 134 through a first partition 107 and into a second region of space 119 provides restricted flow during pumping so that there will be a pressure differential across a boundary formed by the first partition 107 and the first conductance orifice 134 between the first region of space 116 and the second region of space 119.

Second and third partitions 110, 113 have second and third ion conductance orifices 137, 140. The second and third partitions 110, 113 also have respective edges 143, 146 spaced adjacently to a primary rotor 149 or stator or a set of rotors and stators forming a second stage 152 of the turbomolecular pump 104 in accordance with the embodiment of FIG. 6 of the present invention. The second and third ion conductance orifices 137, 140 and limited cross sectional area between the respective edges 143, 146 and the primary rotor 149 form restrictions to flow and restrictions to passage of molecules from one region of space to another during operation of the pump 104.

It is to be understood that one or more turbomolecular pumps with respective partitions, as variously described throughout this specification, in combination with separately backed diffusion pump(s) may be used without departing from the spirit and scope of the present invention. For example, substituting a diffusion pump for the first stage 128 in the configuration shown in FIG. 6 would have the advantage of efficiently pumping light molecules such as hydrogen and helium, while at the same time maintaining a high degree of isolation from back diffusion of pumping fluid from the diffusion pump into an adjacent chamber.

FIG. 6 illustrates how the present invention can be applied together with two stage differential pumping for lower overall pressures in the lowest pressure regions. The embodiment of FIG. 6 could be used where it is required to remove large volumes of low molecular weight gasses in addition to the advantage of removing higher molecular weight gases. The configuration shown in FIG. 6 could use a plurality of discrete turbomolecular pumps, or a diffusion pump along with a turbomolecular pump in place of the split flow pump illustrated, as described above. For such a configuration, separate roughing pumps like pump 115 may additionally be utilized. Thus, a high degree of isolation from backstreaming of the diffusion pump chamber into the turbomolecular pump chamber could also be achieved.

Figure 7:
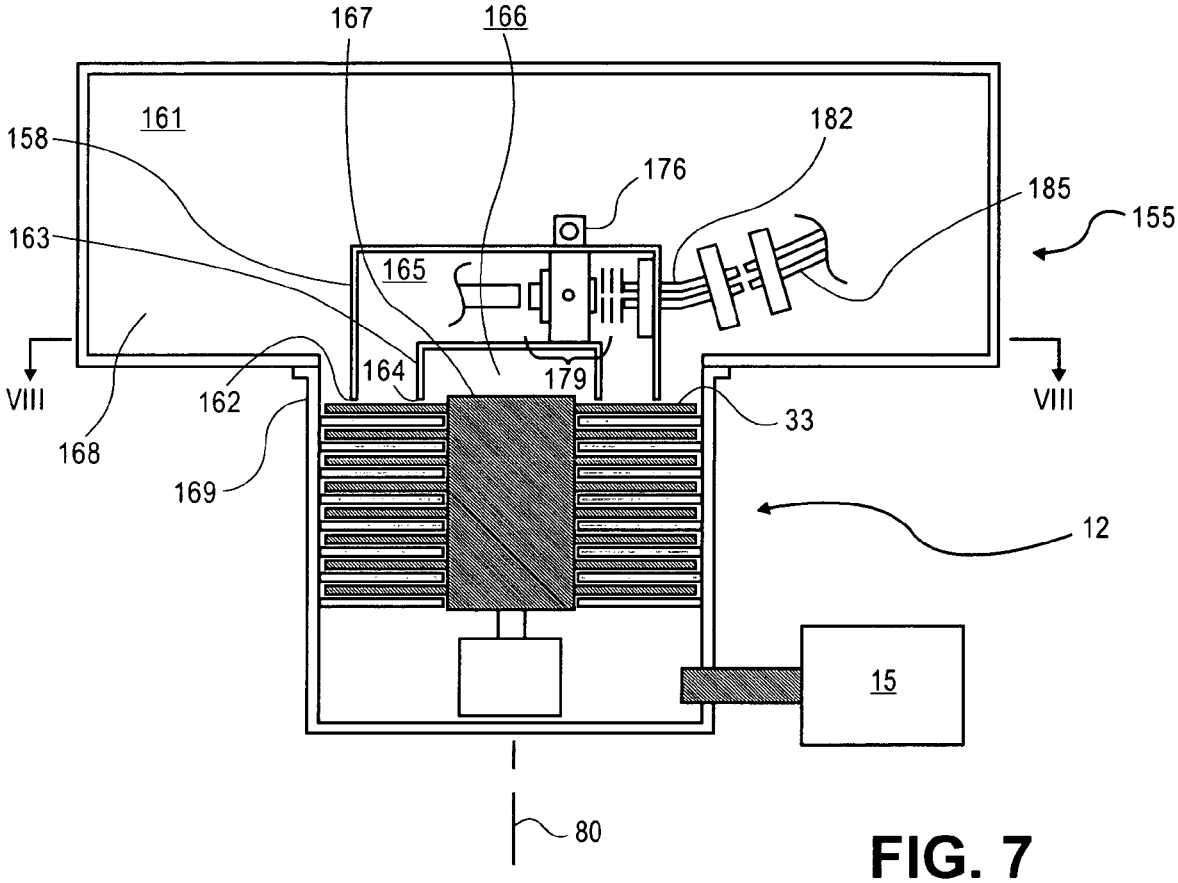
FIG. 7 is a diagrammatic view of a vacuum chamber and pump according to another embodiment of the present invention.

FIG. 7 is a diagrammatic view of a vacuum chamber 155 and a turbomolecular pump 12 in accordance with another embodiment of the present invention. It has been found that deviations in the expected degree of isolation (based on mass alone) can occur for organic compounds. This may be due to the mean sojourn time of adsorbed species on the turbine blades or rotors. Adsorbtion of the species' molecules on the rotors may thus allow the molecules to be carried by the rotating blades into subsequent chambers if the partitions extend radially across the face of the pump inlet, as shown and described in the embodiments of FIGS. 1 and 3-6. The embodiment shown in FIG. 7 is a configuration that may be used to resolve this issue. The configuration of the FIG. 7 embodiment provides additional advantages while maintaining good isolation for common contaminants such as pump oils.

FIG. 7 shows a first cylindrical partition 158 used to spatially separate a first region of space 161 from one or more additional regions of space that are differentially pumped by the methods of the present invention. As described previously with regard to other partitions, the first cylindrical partition 158 has a first end with an edge 162 that is slightly spaced from, yet adjacent to, the inlet face of the primary rotor 33. A second cylindrical partition 163 may be concentrically positioned relative to the rotational axis 80 of the turbomolecular pump and within the first cylindrical partition 158. The second cylindrical partition may have a first end with an edge 164 that is slightly spaced from, yet adjacent to, the inlet face of the primary rotor 33. The cylindrical partitions 158 and 163 may be substantially open at their first ends that are adjacently spaced from the primary rotor 33. The cylindrical partitions 158, 163 may be substantially or completely closed at their opposite second ends that are remote from the primary rotor 33. Thus, the first and second cylindrical partitions 158, 163 may form a second region of space 165 between the first and second cylindrical partitions 158, 163. A third region of space 166 may be defined within the second cylindrical partition 163, between the second cylindrical partition 163 and a hub 167 of the primary rotor 33 of the turbomolecular pump 12.

Figure 8:
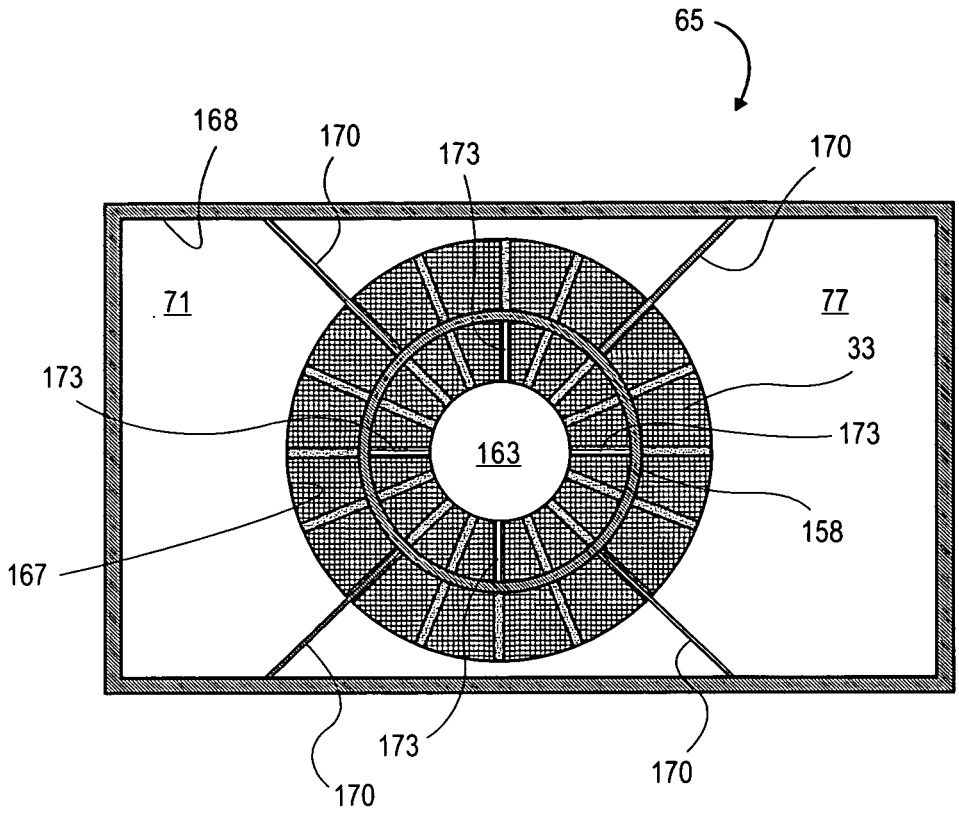
FIG. 8 is a diagrammatic sectional view taken along line VIII-VIII of the vacuum chamber and pump of FIG. 7 showing the face of the rotor that extends radially outward beyond the partitions.

FIG. 8 is diagrammatic sectional view taken along line VIII-VIII of FIG. 7 showing an example of how the first cylindrical partition 158 may be attached to the inner walls 168 of the vacuum chamber 155. The first cylindrical partition 158 may be supported on the inner walls 168 by an insulated bracket or by brackets 170 that have small cross sections of material between the first cylindrical partition 158 and the inner walls 168, as shown in FIG. 8. Thus, the first cylindrical partition 158 may be thermally insulated relative to the vacuum chamber 155. Likewise, the second cylindrical partition 163 may be attached to the first cylindrical partition by insulated brackets or by brackets 173 that have only small cross sections of material between the second cylindrical partition 163 and the first cylindrical partition 158. On the other hand, in some embodiments, it is desirable to thermally connect the second partition 163 to the first partition 158, in which case the brackets 173 may have larger cross sections of conductive material or otherwise provide heat conduction between the partitions. In order to thermally isolate the cylindrical partitions 158, 163 from inner walls 168 of the vacuum chamber 155, the first cylindrical partition 158 may alternatively be supported within the vacuum chamber 155 by a mechanism or structure other than one that is physically in contact with inner walls 168 of the vacuum chamber 155. For example, the first cylindrical partition 158 may be attached to a housing 169 of the turbomolecular pump 12, and the second cylindrical partition may be attached to the first cylindrical partition 163.

On the other hand, the first and second cylindrical partitions 158, 163 shown in FIGS. 7 and 8 may be fabricated with a heat conductive material such as aluminum and may be heated by one or more heater element 176. In this way, an ion source 179 or other device such as a prefilter 182 that is wholly or partially contained in the second region of space 165 can be heated to a much higher temperature than the inner walls 168 of the vacuum chamber 155 itself. This configuration substantially keeps an adsorbed species that is emanating from the inner walls 168 of the vacuum chamber 155 or from the hub 167 of the turbomolecular pump 12 from being in the line-of-sight of the ion source 179. This would have the benefit of further reducing background contaminants while still allowing the use of polymeric components such as o-rings in association with sample and buffer gas introduction mechanisms, for example. The polymeric components can thus be isolated from the high temperatures that would otherwise destroy them and potentially introduce additional contamination into the system. Conversely, a contaminant emanating from the ion source can be inhibited from condensing on surfaces inside the vacuum chamber 155 including surfaces of ion optical elements and the hub 167 of the turbomolecular pump.

There is also a cleansing benefit in applying heat to ion sources where contaminants are typically introduced and functionality is reduced by residuals from the sample. Accordingly, heating the ion source 179 and related elements will bake off the residuals and reduce the frequency and amount of cleaning that is required.

The configuration of FIGS. 7 and 8 enables ions to be transferred from the ion pre-filter 182, for example, into a main quadrupole 185 of a spectrum analyzer in the first region 161 that may be maintained at a lower pressure in accordance with the principles of the present invention. In the embodiment of FIGS. 7 and 8, the first region of space 161 is less subject to introduction of contaminants that are associated with the greater number of ion optical elements that are shown to be contained within the second region of space 165. As may be appreciated, additional partitions and/or additional pumps or stages can be incorporated together with the embodiment of FIGS. 7 and 8.

Figure 9:
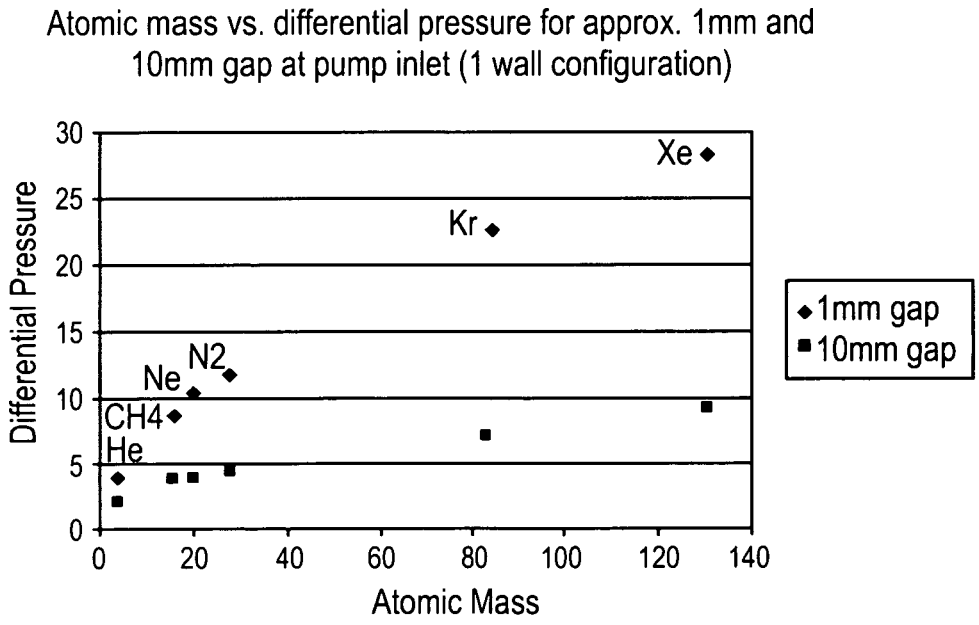
FIG. 9 is an example graph showing a comparison of results when the partition is spaced adjacent to the face of the rotor versus when the partition is spaced further away.

FIG. 9 is a graph that illustrates the loss in differential pumping performance when the gap or space between the rotor and the partition is increased from one millimeter to ten millimeters. A desired distance between a partition and a rotational axis of the pump can be predetermined and selected to yield the desired ratio of pumping/pressures in the respective regions of space within a particular vacuum chamber. As taught by the description of the embodiment shown in FIGS. 7 and 8, partitions can be placed to form a region of space that surrounds the central axis where little or no pumping occurs, or at a location radially outward therefrom where more pumping occurs.

While specific embodiments have been shown and described, an embodiment of the present invention may be more generally described as including a mechanism for differentially pumping a mass spectrometer. The mechanism includes a turbomolecular pump affixed to a vacuum chamber or vacuum manifold. The turbomolecular pump has a primary rotor or stator. The mechanism includes one or more partitions in contact with and dividing the vacuum chamber. The one or more partitions are maintained in close proximity to a face of the primary rotor or stator. The proximity may be less than approximately ten millimeters. In one case, the proximity is less than approximately two millimeters. The proximity may be less than approximately one millimeter.

It should also be noted that the mechanism for differentially pumping a mass spectrometer includes a structure connected to an interior of the vacuum chamber. The structure may include one or more partition that regionalizes the vacuum chamber. The vacuum chamber thus has a plurality of regions in spatial communication with each other. The plurality of regions have different pressures relative to each other during operation of the turbomolecular pump. The structure is maintained in close proximity to a face of the primary rotor or stator of the turbomolecular pump. The proximity of the structure may be in any of ranges described herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications may be made without departing from the spirit and scope of the invention.

The invention claimed is:

1. A mass spectrometer assembly, comprising:

a mass spectrometer;

a vacuum chamber having an interior for surrounding at least one low pressure element of the mass spectrometer, the vacuum chamber having a partition isolating a first region of space from a second region of space within interior of the vacuum chamber, the partition supported on an inner wall of the vacuum chamber; and a turbomolecular pump operably connected to the vacuum chamber, the turbomolecular pump having a primary rotor having a rotor face defining a boundary of the first and the second regions, wherein the first and second regions of space have different pressures relative to each other during operation of the turbomolecular pump;

wherein the partition is supported such that an edge of the partition is adjacent to the rotor face such that the rotor face is directly in contact with the first and the second regions.

2. The vacuum pump system of claim 1, wherein the partition is connected to the inner wall of the vacuum chamber along a majority of an inner perimeter of the vacuum chamber.

3. The vacuum pump system of claim 1, wherein the edge is less than approximately two millimeters from the rotor face.

4. The vacuum pump system of claim 1, wherein the edge is less than approximately one millimeter from the rotor face.

5. The vacuum pump system of claim 1, wherein the partition is thermally insulated from the inner wall of the vacuum chamber.

6. The vacuum pump system of claim 1, wherein the partition is a first partition, the vacuum pump system further comprising a plurality of partitions including the first partition and a second partition, the first and second partitions isolating a third region of space between the first and second partitions.

7. The vacuum pump system of claim 6, wherein:

the first partition is a first cylindrical partition and the edge is a first edge forming a first open end of the first cylindrical partition, the first cylindrical partition having a first closed end opposite the first open end;

the second partition is a second cylindrical partition having a second open end formed by a second edge supported adjacent to the rotor face, the second cylindrical partition having a second closed end opposite the second open end; and the second cylindrical partition is disposed within the first cylindrical partition.

8. The vacuum pump system of claim 6, further comprising a heater thermally connected to the first partition.

9. The vacuum pump system of claim 1, wherein the partition is a first partition, the vacuum pump system comprising at least three partitions including the first partition, a second partition, and a third partition, the three partitions and the inner wall forming at least four regions of space within the vacuum chamber.

10. The vacuum pump system of claim 1, wherein the partition is formed as a unitary structure extending from the inner wall of the vacuum chamber to the edge adjacent to the rotor face.

11. An ion optical device assembly, comprising:

an ion optical device;

a vacuum chamber having an interior for surrounding at least one low pressure element of the ion optical device, the vacuum chamber having a partition isolating a first region of space from a second region of space within interior of the vacuum chamber, the partition supported on an inner wall of the vacuum chamber; and a turbomolecular pump operably connected to the vacuum chamber, the turbomolecular pump having a primary rotor having a rotor face defining a boundary of the first and the second regions, wherein the first and second regions of space have different pressures relative to each other during operation of the turbomolecular pump;

wherein the partition is supported such that an edge of the partition is adjacent to the rotor face such that the rotor face is directly in contact with the first and the second regions.

12. The vacuum pump system of claim 11, wherein the partition is connected to the inner wall of the vacuum chamber along a majority of an inner perimeter of the vacuum chamber.

13. The vacuum pump system of claim 11, wherein the edge is less than approximately two millimeters from the rotor face.

14. The vacuum pump system of claim 11, wherein the edge is less than approximately one millimeter from the rotor face.

15. The vacuum pump system of claim 11, wherein the partition is thermally insulated from the inner wall of the vacuum chamber.

* * * * *